United States Patent [19]

Dambre

[11] Patent Number: 4,645,718

[45] Date of Patent: Feb. 24, 1987

[54] FERROUS SUBSTRATE WITH RUBBER ADHERENT METAL COATING AND METHOD OF MAKING THE SAME

[75] Inventor: Paul Dambre, Kemmel, Belgium

[73] Assignee: N.V. Bekaert S.A., Zwevegem, Belgium

[21] Appl. No.: 785,554

[22] Filed: Oct. 8, 1985

[30] Foreign Application Priority Data

Oct. 23, 1984 [GB] United Kingdom ..... 8426746

[51] Int. Cl.[4] ..... B32B 15/20; B32B 15/00; C25D 5/44; B60C 9/14

[52] U.S. Cl. ..... 428/625; 428/677; 428/684; 57/902; 204/35.1; 204/37.1; 204/38.7; 204/40; 156/124; 156/910; 152/451; 152/527; 152/556; 152/565

[58] Field of Search ..... 428/625, 677, 684; 57/902; 204/35.1, 37.1, 40, 38.7; 156/124, 910; 152/451, 527, 556, 565

[56] References Cited

U.S. PATENT DOCUMENTS 2,078,917 4/1937 Malone .
2,563,113 8/1951 Hindin et al. ..... 154/130
3,858,635 1/1975 Nakamoto et al. ..... 152/330
4,330,592 5/1982 Tsukamoto et al. ..... 428/378
4,446,198 5/1984 Shemeniki et al. ..... 428/625
4,502,895 3/1985 Trubitsyn et al. ..... 148/11.5 Q

OTHER PUBLICATIONS

Fundamental Aspects of Rubber Adhesion to Brass Plated Steel Tire Cords, W. J. Van Ooij, 346 Rubber Chem., vol. 52, No. 3, pp. 605-643.

Mechanism of Rubber to Brass Adhesion, Effect of Rubber Composition on the Adhesion, W. J. Van Ooij, 112th Meeting Rubber Div., ACS, Oct. 4-7, 1977.

*Primary Examiner*—John E. Kittle
*Assistant Examiner*—Patrick J. Ryan
*Attorney, Agent, or Firm*—Shlesinger, Arkwright, Garvey & Fado

[57] ABSTRACT

A rubber adherable ferrous substrate for use in reinforcing vulcanizable elastomeric products includes a cold worked steel wire having a brass alloy coating of specified compact structure on its surface. There is provided also a process for covering a steel wire substrate with a compact alloy coating, in particular a thin brass diffusion coating having a specified permeability.

24 Claims, No Drawings

FERROUS SUBSTRATE WITH RUBBER ADHERENT METAL COATING AND METHOD OF MAKING THE SAME

This invention relates to ferrous substrates covered with a rubber adherent metal coating, such as e.g. copper and copper-based alloy platings. More particularly, the invention relates to diffused copper-zinc or brass alloy coatings useful for bonding steel wires and steel cords to rubber so as to form reinforced elastomeric articles, such as e.g. rubber tires, belts and hoses. The present invention specifically reveals a steel reinforcing element provided with a compact brass adhesion coating, which is substantially free from pores. It also discloses a method for applying such an improved adhesion coating onto ferrous substrates, especially on steel wire and cords for tire cord applications. The compact coating of this invention is capable of improving cord surface properties, in particular the resistance to $H_2$-induced brittle failures and to corrosive attack, thereby securing a durable bond in severe service conditions.

A common method for bonding rubber to steel elements consists in electroplating brass from an alloy plating bath onto the steel surface. A more recent method comprises the successive electrodeposition of copper and zinc as two separate layers followed by a thermodiffusion treatment whereby the copper and zinc atoms diffuse into each other so as to form a brass layer of desired composition and thickness. The brass composition usually ranges from 55 to 75% of copper, the remainder being predominantly zinc with sometimes an additional ternary alloying element (e.g. Ni, Co, Sn, Fe, . . . ) present in varying lesser amounts (up to max. 10%). Most frequently the copper content ranges from 60 to 72% Cu, while the brass coating thickness may vary from 0,05 to 0,50 μm, mostly from 0,10 to 0,40 μm. This conventional brass coating plated onto ferrous substrates such as wire and cord is in general satisfactory for securing an adequate level of (initial) adhesion, between substrate surface and surrounding rubber compound.

However, high-duty applications of steel reinforced rubber products (such as e.g. heavily loaded tires or belts working in wet or aggressive conditions) are demanding enhanced bond stability and cord durability. It has been observed that the adhesive and protective properties of conventional brass coatings plated onto steel wire and cords are often insufficient for this purpose, and especially that cord failures and bond degradation can occur as a result of the combined effect of humidity, corrosion, heat ageing and hydrogen embrittlement.

To meet these higher demands various coating-related modifications and alloy formulations have been tried recently, such as the development of ternary brass alloys (CuZnNi, CuZnCo), the use of double coatings whereby e.g. zinc, nickel or another protective metal is applied between brass and the ferrous substrate, or the application of a thin surface film of tin, lead or zinc on top of the brass coating. Other processes include e.g. the use of special organic surface finishings or the treatment of the brass surface with reactive liquids and gases, and further the modification of the usual rubber compounds with specific additives or adhesion promotors such as complex metallic salts (e.g. based on Ni, Co, . . . ), organo-metallic compounds, RFS-agents and the like. These attempts and other suggestions, however, were either not fully satisfactory or have not yet found commercial applications for reasons of cost, processing problems and the like.

As contrasted with said prior art developments the novel coating and method of this invention have distinct technical and economical advantages. As compared to conventional coatings, it is surprisingly effective in overcoming the instabilities in cord life and in adhesion retention related to the porous nature of said coatings. Therefore a primary object of the present invention is to provide a metallic adhesion coating, more in particular a diffused brass coating, with a tightly compacted structure featuring a significantly smaller degree of porosity and affording an enhanced resistance against hydrogen embrittlement and a better corrosion protection of the ferrous substrate in comparison with prior art coatings. Another object is to provide coated substrates having an improved durability and bonding behaviour, especially when exposed to severe working conditions. A further object of this invention is to provide a method for applying a compact coating onto ferrous substrates, in particular steel wire and cord. A final object is to obtain better rubber composites by embedding the thus coated substrates in rubber material and vulcanizing.

The present invention and its advantages will hereinafter be described with particular reference to the well-known diffused brass adhesion coating and to the method used in making steel wire and cord for tire applications without being limited to this embodiment.

The conventional process to obtain a diffused brass alloy coating normally comprises the consecutive electrolytic deposition of a copper and zinc layer, followed by a thermodiffusing step during which Cu and Zn intermigrate and form a brass alloy. This diffusion step involves heating the plated wire in air between 450° and 600° C. for a few seconds. The thus coated substrate is then generally submitted to a finishing plastic deformation or shaping process to obtain a product of prescribed final dimensions and whereby the brass coating is subjected to heavy straining under transverse pressure so as to compress its surface. When the substrate is a wire, this shaping and transverse compressing step may be carried out by further drawing the brassed wire to a smaller diameter.

A major drawback of this process relates to the fact that the final product, e.g. a brassed wire ready to be twisted to a steel cord, exhibits a brass surface which is not free from pores. In practice, the degree of porosity is not constant over the entire wire surface and can also vary from batch to batch, which may give rise to unexpected fluctuations in adhesion behaviour. Moreover, a porous coating cannot afford sufficient corrosion protection to the ferrous substrate and frequently fails in maintaining cord durability and bond retention, especially in severe working conditions involving hydrogen embrittlement and moisture penetration.

During our extensive trials and investigations to solve this persistant problem, we have found that certain peculiar aspects of the prior art brass coating and diffusion process induce a porous layer structure. First we observed that the consecutive deposition of a copper and zinc layer on the ferrous substrate already results in a coating which is generally not free from porosity. Indeed, during electroplating of the ferrous substrate imperfections in surface coverage may occur due to generally present irregularities (asperities, microroughness, smut on the substrate surface). These defects result in macropores. On the other hand, electrodeposits virtually always contain micropores. These are difficult to prevent because of the mechanism of electrolytic layer formation and growth: here tiny growth defects are built in owing to local differences in micro-crystal growth rate, imperfect atomic stacking and related differences in grain size. Microvoids may also form as a result of occluded bath impurities or extraneous particles. In practice, macroporosity and surface coverage can be improved by a better surface preparation of the substrate, such as polishing or deep chemical cleaning. Micropores, however, are difficult to avoid and to control due to the intrinsic growth mechanism of electrodeposited layers and to codeposition of incidental bath impurities. This initial porosity is affected in a significant way when submitting the plated substrate to the next processing steps.

During thermodiffusion normally carried out by heating the plated substrate in air, the coating surface gets readily oxidized. Hence, owing to the as plated porosity, the coating is also subjected to internal oxidation whereby pores and adjacent grains are preferentially oxidized so as to form stabilized microdomains surrounded by an oxide film. Considerable initial porosity may also facilitate substrate iron penetration into the brass coating.

Further, we observed that during subsequent plastic deformation by drawing, rolling, compressing and the like, the oxidized pores and micrograins are barely or not at all cold welded together. Hence, after final processing the coated substrate displays a poorly compacted brass structure containing a variable amount of pore defects and more or less iron penetration (even substrate iron particles). In practice, the incidental presence of less deformable beta brass (i.e. a Cu-Zn alloy containing less than 62% Cu due to uncomplete diffusion or to the existence of a concentration gradient) will generally also hinder coating compressibility and increase porosity of the brass layer. Hence, a conventional diffused brass layer after processing, e.g. after drawing a coated and diffused ferrous wire substrate, has two defects: it is still porous to a large and variable extent and it contains occluded iron. It follows that these defects will generally contribute to the deterioration of the substrate surface and to poor adhesion retention. Indeed, the presence of pores and iron particles in the brass coating will make the underlying substrate more prone to corrosive attack and to hydrogen embrittlement, for instance when the coated substrate has been stored in relatively humid conditions and/or when the rubber to be vulcanized to the brass coated substrate contains moisture. Even when humidity is no problem before and during the vulcanization bonding process, deterioration of the adhesive bond by humidity may still occur later on during service of the reinforced rubber article. In the case of steel cord reinforced tires, belts and the like external moisture (e.g. wet air) may enter the rubber by slow permeation, respectively by quick migration from incidental cuts to the interior (cut corrosion). In both cases the embedded cords are affected by accumulated moisture.

We have found that a compact adhesion coating, e.g. a brass diffusion layer obtained according to the compact coating method of the present invention, is surprisingly effective in overcoming the previously mentioned shortcomings of prior art brass coatings. Characteristic of a compact coating of this invention is that it possesses a high densified structure which shows a much smaller degree of porosity defects as compared to conventional coatings. Accordingly, corrosive attack and hydrogen embrittlement of the coated steel substrate is markedly retarded. According to a further aspect of the present invention a compact alloy coating is provided on ferrous substrates whereby the outer surface layer of said alloy coating is substantially free from substrate iron contamination. When the compact adhesion layer is an ironfree metal alloy it comprises not more than 0.5% Fe and preferably less than 0.1% in weight iron (solute and non-solute iron). According to a specific embodiment of this invention such alloy coating may then comprise copper and zinc diffused into each other to form a brass composition intended for bonding steel reinforcing elements to rubber and thereby enhancing cord durability and adhesion retention.

It is still another object of the present invention to provide ferrous substrates, such as steel wires having a compact brass coating comprising copper and zinc and additional alloying elements, such as tin, nickel, cobalt and others.

It is yet another object of this invention to provide rubber composite materials vulcanized in the presence of ferrous substrates such as steel wires and cords having a compact alloy coating, comprising essentially Cu and Zn. The ferrous substrates can thereby be incorporated in view of reinforcing the rubber.

The invention will now be clarified by a description of some embodiments thereof and by a method of producing the alloy coating thereon.

The ferrous substrates to be coated can in principle have any shape such as a plate, rod, profile, tube, strip or wire on which a deformation step can be applied (causing transverse compression and densification of the surface layer as to form a compacted coating thereon), e.g. by rolling, hammering, extrusion or by drawing through a die. When the substrate is of steel, e.g. a steel wire, it may contain between 0.4 and 1.2% by weight of carbon, preferably 0.6 to 1.0% C.

In the case of a substrate in the form of a wire, such as e.g. high-carbon steel wire the compact alloy coating is obtainable by consecutively plating the wire with a first metal layer and thereon plating at least one additional, e.g. a second metal layer and by subsequently submitting said multi-layer coating, which is generally not free from macropores and microporosity as explained hereinbefore, to a densification step before substantial internal oxidation of said coating can occur, i.e. before storing or before heating the coated substrate in case of thermodiffusion processing. Hence a transverse compression step to close the pores will be applied onto the green coating within a short time after plating, e.g. in line with the plating step or shortly thereafter in a separate operation. As we found out, this is can be done by drawing said coated wire through a die so as to reduce its thickness to a given extent, whereby the coating is thoroughly compacted and the pores disappear by the mechanism of cold pressure weld bonding. Alternative methods to obtain a compact coating of this invention include e.g. subjecting the as plated wire to a compressing plastic deformation (with reduction in diameter) by a cold rolling, or compacting the wire surface layer by circumferential (skin) rolling, by peening or by another suitable surface compressing method (with small or negligible change in wire diameter). Finally the predeformed wire will be heated to an appropriate temperature for a sufficient time to interdiffuse the two metal layers into each other so as to produce the required alloy coating which will then have a smooth closed surface which is substantially free of pore defects. If desired the thus alloy coated wire may further be drawn so as to produce an additional compaction of the alloy coating.

In the case the ferrous substrate is a plate or profile, the compaction step may be carried out by cold rolling, forging, hammering, extrusion and the like. Due to the fact that the compaction step, preceding possible internal oxidation by storing and by heating, substantially closes all the pores in the coating, the penetration of substrate iron into the coating is largely impeded. This is particularly beneficial when the coated substrate is to be further deformed to smaller dimensions as in the case of wire drawing. Indeed, a compact coating (free of oxidized pores) is more resistant to local breaks and has a better ductility, which favors its smoothness and continuity even after large deformation. Accordingly, a drawn coated steel wire of this invention is less sensitive to the appearance of surface defects (e.g., bare spots, iron intrusion, . . . ) and hence displays a better resistance to the harmful effect of penetrating corrosion and hydrogen.

In a preferred embodiment, the compact coating of the present invention is a rubber adherent Cu—Zn alloy or brass composition. In this case a first layer of copper is electrodeposited onto a ferrous substrate, such as e.g. high-carbon steel wire, whereas a second layer of zinc is electroplated on the Cu-deposit. Optionally said electroplating steps may be reversed, i.e. first plating zinc and thereupon copper. The as plated thickness of said single layers of Cu and Zn are chosen as to form a rubber adherent brass composition having preferably an average Cu/Zn ratio by weight ranging from 1 to 3, and more preferably from 1.5 to 2.5.

In another embodiment, a favourable bonding behaviour to rubber compositions is realized when less than 10% by weight of either Sn, Ni or Co or of a combination of these elements is added to the Cu—Zn alloy coating. In other cases these additional alloying elements may be applied as a top coating on a compacted diffused brass layer of this invention.

When it is the purpose to make brass coated steel cords for reinforcing rubber, the final thermal diffusion treatment of the compacted Cu—Zn coating may also be carried out on the finished cords. Compositional fluctuations and defects in the brass coating as could be the case in twisting said wires with previously diffused coatings as made in a prior art method is thus avoided because the proper brass composition is obtained after cord manufacturing. The absence of a final drawing step on the coated wires which are thermodiffused at end diameter or cord, offers the additional advantage that no contamination occurs of the outer brass surface by traces of wire drawing lubricant residues. Said surface contamination is undesirable in view of obtaining consistent adhesive bond properties on vulcanizing said wires in the presence of rubber.

Further additional advantages of the process for producing a densified brass alloy coating according to the present invention reside in the fact that wire drawability problems and local tearing of the brass surface due to the incidental presence of less deformable beta brass in the coating can be largely avoided. Indeed, the preceding coating compaction step considerably activates the thermal Cu—Zn diffusion process whereby the amount of predeformation can be chosen to provoke already premixing and alloying of Cu and Zn. This results in a quicker diffusion rate and less energy consumption. Moreover, it is yet possible to draw steel wires with a critical Cu/Zn ratio (even below 62% of Cu) since the beta brass fraction resulting from a thermodiffusion treatment is found to be less harmful to wire drawability when it occurs in a brass coating with already densified structure. In the case of additional coating compaction by (increasing) wire drawing reduction before thermodiffusion, the beta brass effect gradually decreases to become nil in the extreme case when shifting the thermodiffusion step to final wire diameter or to finished cord.

To distinguish a compact coating from a conventional one and to assess the improved properties and advantages of the compact coating prepared in accordance with the present invention two special tests have been developed which both relate to the porosity degree of the coating structure.

A first test reveals the influence of hydrogen permeability of the coating on substrate durability. It measures the relative aptitude of compact coatings to protect the ferrous substrate against hydrogen embrittlement failures. In this test a coated and drawn wire is submerged in a hydrogen charging medium and at the same time the wire surface is subjected to a preset tensile stress (e.g. by bending the wire over a given radius). Test conditions are as follows: aqueous solution of 1N $H_2SO_4$ containing 0.5% FeS, charging current of 10 Amp/m$^2$, binding stress of 600N/mm$^2$. During the test hydrogen is absorbed by the stressed substrate until it is completely embrittled and fractures. The time to failure is indicative of the hydrogen embrittlement resistance of the coated wire. Thus, for a given wire substrate provided with different brass coatings, the time to failure is a relative measure of $H_2$-permeability and porosity of the coating. Indeed, compact coatings are normally expected to slow down hydrogen migration from the charging solution to the stressed substrate surface, thereby delaying the time to brittle failure.

The $H_2SO_4$-test not only reveals the more or less compact nature of the brass coating, but is also an accelerated simulation of the expected real life behaviour of the coated substrate under stress-corrosion circumstances, e.g. a brassed wire or cord embedded in a tire rubber material exposed to aggressive service conditions. When these cause hydrogen release (for instance as a result of corrosion reactions, catalytic split off effects, . . . ) subsequent embrittlement of the rubberized substrate by hydrogen pick-up will occur.

A second method gives a good (indirect) characterization of coating porosity. It measures the corrosion resistance (iron loss) of a brass-coated material which is directly related to the presence of pores in the brass coating. Here the coated substrate (wire, cord, . . . ) is submerged in an aqueous acid solution of prescribed concentration for a given time. Said solution primarily attacks the iron present below the coating (substrate surface). The less compact, i.e. the more pores in the brass coating, the greater the amount of iron dissolved.

The Fe-solution test can be carried out in two ways.

(1) Nitric acid test (severe quick test)

A brassed wire specimen (wire or cord) of given weight or length is dipped in 0.5N $HNO_3$ under specified conditions:

100 ml of 0.5N $HNO_3$ solution at 22.5° C.
magnetic stirring of solution at 500 rpm
residence time: 60 seconds After exactly one minute the specimen is removed from the solution and the amount of iron dissolved is determined by atomic-absorption spectrometry (A.A.S.) as ppm iron (in comparison with standard iron solutions of the same nature). From the analysis results (expressed in ppm Fe) the average iron loss of the substrate can be calculated as gram iron per square meter of specimen surface or as milligram iron per gram of specimen.

(2) Dilute hydrochloric acid test

A given weight or length of brassed wire or cord is submerged in an aqueous solution containing 0.05N HCl under following conditions:

200 ml 0.05N HCl solution (containing preferably also a buffering compound)

test temperature: 40° C.

immersion time: 15 minutes (magnetic stirring at 500 rpm).

After 15 minutes the amount of iron dissolved is determined analytically by means of A.A.S. as ppm Fe. Iron loss is calculated as mg Fe per gram of specimen.

EXAMPLE 1

A high-carbon steel wire with 0.80% C was patented at a diameter of 1.50 mm, covered with a conventional brass diffusion coating and processed to a final diameter of 0.25 mm according to a prior art process, hereinafter referred to as process A.

An identical steel wire, patented and processed to a diameter of 0.25 mm as in process A was covered with a compact brass coating according to the invention. This new process is hereinafter referred to as process B.

A: plating of patented wire with a copper and a zinc layer followed by thermodiffusion (4 sec. at 580° C.) so as to form a diffused alloy coating with an average composition of 67% Cu and 33% Zn and with a thickness of 1.35 micrometer.

wire drawing to 0.25 mm

B: plating of a copper and a zinc layer on patented wire of 1.50 mm whereby a Cu/Zn weight ratio of 67/33 and a total coating thickness of 1.30 micrometer are obtained. compacting said double-layer coating by drawing the wire to a varying intermediate size.

thermodiffusion of said compact coating at 540° C.

finish drawing to diameter 0.25 mm.

To assess the porosity of the coatings A and B the sensitivity to hydrogen embrittlement was determined on the drawn wires 0.25 mm by measuring the time to failure of $H_2$-charged wire specimens at a stress of 600N/mm$^2$ (hydrogen charging conditions: aqueous solution of 1N $H_2SO_4$ with 0.5% FeS, charging current of 10 Amp/dm$^2$). This $H_2SO_4$-test reveals the permeability of the brass coating to hydrogen and is thus an indirect measure of coating porosity.

TABLE 1

| Process | Results of $H_2SO_4$-test: tensile strength (N/mm$^2$) of 0.25 mm wire | time to failure in minutes, wire condition: non-aged | aged (*) | type of coating |
|---|---|---|---|---|
| A: conventional process 1.5 → 0.25 mm | 3200–3400 | 1.2 | 0.2 | conventional (porous) |
| B: compaction of coating, thermodiffusion (TD) and finish drawing to 0.25 mm | | | | |
| B1 compaction from 1.5 to 1.2 mm, TD at 1.2 mm | 3200–3300 | 9 | 1.5 | compact |
| B2 compaction from 1.5 to 1.0 mm, TD at 1.0 mm | 3100–3300 | 6 to 15 | 2.5–12 | compact |
| B3 compaction from 1.5 to 0.8 mm, TD at 0.8 mm | 3050–3200 | 9 to 15 | 3–6 | compact |

(*) aging of drawn wire (150° C. - 30 minutes) to simulate effect of rubber vulcanization heat.

From the results it can be seen that the compact brass coating of the invention lowers hydrogen permeability and increases time to brittle failures by a factor of at least about 5. In the aged wire condition, which is most sensitive to embrittling effects, the coating of conventional process A has virtually lost its protective action. When using wires and cords with a compact brass coating in a rubber vulcanizate cord and bond durability in high-duty conditions (e.g. corrosion fatigue) are improved, because of the fact that hydrogen attack ($H_2$ stemming from humidity effects and corrosion) of embedded wires is considerably delayed.

EXAMPLE 2

The purpose of this example is to show the superiority of compact coatings of this invention over normal brass diffusion coatings with respect to $H_2$-resistance, porosity and corrosion protection. It also shows the influence of wire strength and coating thickness (when drawing to a smaller diameter wire strength increases and brass layer thickness decreases). A steel wire (with a diameter of 1.10 mm and with 0.78% carbon) is provided with a common diffusion brass layer of about 1 μm (66% Cu—34% Zn) and is thereafter drawn to a diameter of 0.22 mm, resp. 0.175 mm. From the same steel material wires are drawn with diameters 0.22 mm and 0.175 mm and having a compact brass coating on their surface. This is realized by submitting immediately after Cu and Zn plating, the coated wire to a compacting predeformation step (drawing from diameter 1.12 mm to 0.90 mm) followed by thermodiffusion and drawing to end diameters 0.22 and 0.175 mm. On these wires the hydrogen embrittlement test and the porosity test in 0.5N $HNO_3$ have been carried out.

TABLE 2

| Wire material | Tensile strength (Newton) | Time to failure (minutes) in $H_2SO_4$-test: as drawn | aged 1 hr at 150° C. |
|---|---|---|---|
| Conventional coating | | | |
| ϕ 0.22 mm | 2740–2900 | >15 | 3.10 |
| 0.175 mm | 3050–3200 | 12.30 | 0.50 |
| Compact coating | | | |
| ϕ 0.22 mm | 2710–2870 | >15 | >15 |
| 0.175 mm | 3040–3210 | >15 | 7–13 |

The results show that wires with compact coating are much less sensitive to hydrogen embrittlement. This improved behaviour is largely attributed to the reduced porosity of the coating as can be taken from the figures in table 3.

TABLE 3

| Wire material | Porosity assessment (nitric acid test) Dissolved iron, in mg Fe/m² material |
|---|---|
| Conventional coating | |
| ϕ 0.22 mm | 20.4–26.9 |
| 0.175 mm | 27–39 |
| Compact coating | |
| ϕ 0.22 mm | 11.8–14 |
| 0.175 mm | 13.9–18.7 |

EXAMPLE 3

Cords 4×0.25 mm consisting of conventional brass-plated 0.70% C-steel wires having a Cu 67—Zn 33 diffused alloy coating of varying thickness are compared with cords made of wires covered with a compact brass coating of this invention. In this example coating compaction was carried out by passing the wires, immediately after Cu and Zn-plating, through a number of roller sets, allowing to compress wire surface and coating over its entire circumference. Cord samples are dipped for 15 minutes in a diluted hydrochloric acid solution (0.05N HCl) at 40° C. and iron loss is measured in milligram iron per gram of cord, which is indicative of the corrosion resistance of the coated cords. The test also reveals the corrosion protection capacity of the investigated brass coatings, which in fact can be directly related to coating porosity and other surface defects of the drawn wires.

TABLE 4

| Cord 4 × 0.25 mm brass 67 Cu - 33 Zn coating thickness in micrometer | Corrosion resistance of wires and cords determined as iron loss in 0.05 N HCl — Iron loss, mg Fe/g of cord: conventional brass | compact brass coating |
|---|---|---|
| 0.31 μm | 3.7–5.3 | 1.20–1.55 |
| 0.23 μm | 4.10–6.60 | 1.37–1.64 |
| 0.17 μm | 4.85–7.90 | 1.75–1.80 |
| 0.14 μm | >10 | 3.2–5.5 |

The test results of example 3 show that the cords with compact coating are markedly improved in corrosion resistance as compared to usual brass coatings. It is further shown that a decreasing coating thickness becomes very critical for obtaining a satisfactory corrosion resistance when using a conventional diffused brass plate. The maximum iron loss that can be tolerated depends on wire diameter because the exposed surface area (also in the immersion test) increases with decreasing wire diameter. In normal practice the max. limit is established at 7–9 mg Fe/g for wire diameters of 0.25–0.30 mm (and above) and increases to 13–17 mg Fe/g for fine wire diameters of 0.18–0.15 mm.

From our numerous experiments we have found that the compact coatings of this invention are clearly better in corrosion resistance over the entire diameter range (usually 0.10–0.40 mm), and thus allow to achieve a significant improvement in quality level. Accordingly, the present standard of maximum iron loss (7 to 17 mg Fe/g), which mainly reflects coating porosity and similar defects, can virtually be cut in half. Taking into account the additional influence of coating thickness, the wires and cords plated with a compact brass coating of this invention exhibit a max. iron loss which is given by the following relationship:

$$L_{max}\,(\text{mg Fe/g}) \leqq \frac{1.05}{d} - 2\left(\frac{s-0.25}{s}\right)$$

d: wire diameter in mm
s: brass thickness in micrometer

More preferably the brass coated substrates of this invention have a max. iron loss given by $$L_{max} \leqq \frac{3}{4d} - 2\left(\frac{s-0.20}{s}\right)$$

Briefly, the compact electrodeposited coatings of the present invention have great quality advantages over conventional electroplatings, in particular when the electroplated coating is a diffused brass alloy layer for use in adhering ferrous wires and cords to vulcanized rubber articles, such as e.g. tire materials.

It is further obvious to those skilled in the art that, in addition to diffused brass layers, other electroplated metal and metal alloy coatings, prepared according to a compact coating method described above, also fall within the scope and spirit of the present invention. This is particularly true of alloy coatings produced by thermodiffusing coated substrates comprising several electroplated metal layers forming the alloy constituents, regardless of plating sequence. In the extreme case of a one-metal coating, resp. an alloy plated coating obtained by direct deposition from a single electrolytic bath formulation, the compact coating concept and process of this invention are still valid and valuable.

I claim:

1. A ferrous reinforcing substrate having a rubber adherent brass-alloy coating thereon of an improved porosity property in view of securing a more durable vulcanization bond between said substrate and rubber, the improvement wherein said coating has a compact structure substantially free from macropores and micropores characterized in that said coating comprises an amount of penetrated substrate iron of less than 0.5% of the coating weight, said penetrated substrate iron being predominantly non-solute iron.

2. A substrate as in claim 1, wherein said compact brass coating comprises a maximum of 0.1% of penetrated iron.

3. A substrate as in claim 1, said substrate being in the form of a hard drawn steel wire, wherein said brass coating is comprised of a thermodiffused Cu—Zn alloy.

4. A substrate as in claim 2, said substrate being in the form of a hard drawn steel wire, wherein said brass coating is comprised of a thermodiffused Cu—Zn alloy.

5. A substrate as in claim 1, said substrate being in the form of a cold drawn wire, wherein said brass alloy has a Cu—Zn ratio by weight of between 1/1 and 3/1 and a thickness of between 0.05 micrometer and 0.50 micrometer.

6. A substrate as in claim 1, said substrate being in the form of a cold drawn wire, wherein said brass alloy has a Cu/Zn ratio by weight of between 1.5/1 and 2.5/1 and a thickness of between 0.10 micrometer and 0.40 micrometer.

7. A wire substrate as in claim 5 having a diffused brass surface coating of compact structure, characterized in that the coating porosity simulated and measured by means of an immersion test for 60 seconds in a 0.5N nitric acid solution at 22° C., reveals a maximum iron loss in terms of dissolved iron of between about 20 g $Fe/m^2$ and about 12 g $Fe/m^2$.

8. A wire substrate as in claim 5 having a compact brass alloy coating on its surface, characterized in that the corrosion rate of said substrate when immersed during 15 min. in a 0.05N Hcl solution at 40° C., is limited to a maximum value expressed in mg dissolved iron per gram of substrate given by the formula $$1.05/d-2(s-0.20)/s$$

where d is the wire diameter in mm and s is the coating thickness in micrometers.

9. A wire substrate as in claim 5, having a compact brass alloy coating on its surface, characterized in that the corrosion rate of said substrate when immersed during 15 min. in a 0.05N Hcl solution at 40° C. is limited to a maximum value expressed in mg dissolved iron per gram of substrate given by the formula $$3/4d=2(s-0.20)/s$$

where d is the wire diameter in mm and s is the coating thickness in micrometers.

10. A steel substrate as in claim 1, wherein said substrate is comprised of between 0.4% and 1.2% of carbon.

11. A steel substrate as in claim 1, wherein said substrate is in the form of a wire comprised of between 0.5% and 1.0% of carbon and having a maximum diameter of 2 mm.

12. A substrate as in claim 11, wherein said substrate is in the form of a drawn steel wire having a tensile strength of at least $2700N/mm^2$ and a diameter of from 0.05 to 1 mm.

13. A substrate as in claim 12, wherein said wire substrate has a diameter of from 0.10 to 0.50 mm.

14. A substrate as in claim 12, wherein said substrate is in the form of a strand of wires twisted together.

15. A process for preparing a ferrous substrate with a thermodiffused rubber adherable brass alloy coating of compact structure, comprising the steps of:

(a) plating the substrate with a first layer of a brass alloy forming metal, (b) plating on top thereof at least one additional layer of a brass alloy forming metal, (c) transversely compressing said layers on said substrate to render them substantially free from pores before tarnishing and internal oxidation of the coating can occur, (d) heating the substrate to produce an interdiffusion of the metal coatings so as to form said brass alloy coating, and (e) optionally cold work finishing the thus coated and diffused substrate to a desired end size or shape.

16. A process as in claim 15, wherein said first metal coating layer comprises copper, the second metal coating layer comprises zinc and the interdiffusion heating step produces said brass alloy.

17. A process as in claim 15, wherein said substrate is a steel wire and whereby the compressing step is carried out by plastic working the coated wire to a desired extent by drawing or rolling said wire to a smaller cross-section.

18. A process as in claim 15, wherein said substrate is a stel wire and whereby the compressing step is carried out by plastic working the wire surface coating with minor change in the wire cross-section by passing the wire through circumferential compressing tools.

19. A process as in claim 18, wherein said circumferential compressing tools are rollers having curved surfaces.

20. A process as in claim 15, wherein said substrate is a steel wire and wherein said optional cold work finishing step comprises further transversely compressing said wire to a smaller cross-section.

21. A process as in claim 20, wherein said optional cold work finishing step comprises further drawing said wire substrate to a desired fine end diameter.

22. A process as in claim 15, wherein several substrates with compressed coatings are combined with each other prior to heating to produce the interdiffused alloy coating.

23. A process as in claim 22, wherein said substrates are wires and said wires are combined with each other by twisting them together.

24. A rubber article reinforced with at least one substrate as in claim 1.

* * * * *